US007444952B1

(12) United States Patent
McGann

(10) Patent No.: US 7,444,952 B1
(45) Date of Patent: Nov. 4, 2008

(54) BOAT HULL RINSING DEVICE

(76) Inventor: Leo McGann, 3820 SE. 18th Pl., Cape Coral, FL (US) 33904

( * ) Notice: Subject to any disclaimer, the term of this patent is extended or adjusted under 35 U.S.C. 154(b) by 0 days.

(21) Appl. No.: 11/978,484

(22) Filed: Oct. 29, 2007

(51) Int. Cl.
*B63B 59/06* (2006.01)
*B63C 1/00* (2006.01)
*B63C 3/00* (2006.01)
*B63C 3/06* (2006.01)

(52) U.S. Cl. ..... 114/222; 114/44; 405/3

(58) Field of Classification Search ..... 114/44–48, 114/222; 405/1, 3, 4; 15/1.7, 53.1–53.4
See application file for complete search history.

(56) References Cited

U.S. PATENT DOCUMENTS 5,445,101 A * 8/1995 Koch ..... 114/222

FOREIGN PATENT DOCUMENTS

JP 11001196 A * 1/1999

* cited by examiner

*Primary Examiner*—Ajay Vasudeva

(57) ABSTRACT

Fresh water rinsing of a boat hull of a boat occurs to remove contamination from the boat hull during each raising operation of the boat utilizing a boat lift. The contamination coming primarily from a body of water in which the boat operate. The contamination, if left on the boat hull while positioned on the boat lift and out of the body of water, will have an adverse effect upon the condition of the boat hull. A series of intermittent burst of fresh water from each fresh water discharge occur through a respective angle of discharge in a respective repetitive cycle of passes during the raising operation of the boat lift. Each fresh water discharge is generally fixedly positioned relative to a fixed portion of the boat lift. Rinsing of the boat cradle of the boat lift also occurs to remove contamination therefrom to reduce adverse effects to the cradle.

19 Claims, 18 Drawing Sheets fixed elevational position
146
124
fixed portion
provided fresh water discharges
116
provided boat lift
118
122
discharging fresh water
opposing sides
raising elevational displacement
144
148
fresh water
126
132
130
150
boat cradle
boat
hull
deck
140
rinse
152
120
elevationally displacing the boat cradle
body of water
138

BOAT HULL RINSING DEVICE

BACKGROUND

1. Field of the Invention

Generally the invention relates to devices to rinse a hull of a boat when positioned on a boat lift during a removal of the boat from a body of water. More specifically the invention relates to such rinsing utilizing fresh water to remove the water of the body of water, and other materials, from the boat hull to prevent accumulation of undesirable materials on the hull of the boat.

2. Description of the Prior Art

It is understood that hulls of boats will benefit from being cleaned of contamination from exposure to water of a body of water subsequent to removal from the body of water. Such cleaning will enhance and prolong the life cycle of the boat hull by preventing deterioration associated with leaving the contamination thereon. The term contamination as used herein refers to a very wide spectrum of materials, both organic and inorganic. Contamination may involve living matter which may attach itself to surfaces of the boat hull. Contamination may involve naturally occurring elements as well as man made, or refined, elements which may attach to the surfaces of the boat hull.

Leaving a boat in water for extended periods of time has detrimental effects upon the boat. Fowling of the hull may occur in both fresh water and salt water. The area of the hull at and just above the hull water line is particularly susceptible to fowling. The portion of the hull below the hull water line is also susceptible to fowling due to the inaccessible nature of this area for cleaning while the boat is in the water.

When contamination from the body of water, either from a fresh water body of water or from a salt water body of water, is permitted to remain on the hull of the boat following removal from the body of water the hull can suffer unnecessary deterioration over time.

Numerous methods exist to wash boat hulls once elevated and removed from a body of water. The most common method involves a person manually manipulating a hose to disperse fresh water for rinsing the various surfaces while walking around to gain access to the various areas of the hull of the boat. This is only practical if the person is able to completely move around the boat lift to gain access to both sides of the boat hull. Many boat lifts, particularly in residential setting, are only accessible on one side of the boat lift. Therefore, in these circumstances a less than desirable outcome is obtainable utilizing the manual manipulation rinsing method. Of course some boat lifts are accessible on both sides, such as having surrounding decking of a dock.

Many people who have a boat lift and a corresponding boat routinely keep their boat on the boat lift and raised out of the body of water when not actively using the boat for boating activities. Often the owner will not even leave their boat in the water overnight when not in use. It is common for such a boat to be used repetitively over a span of several days with the boat being placed on the boat lift and elevated above the body of water during inactive periods, such as overnight.

The removal from the body of water following each use of the boat provides an excellent opportunity to clean the hull of the boat. Unfortunately, many boaters fail to take advantage of these opportunities, at least not each and every time. This failure results in contamination being left on the hull of the boat. When the contamination is permitted to dry and harden on the hull adverse effects begin and subsequent washing often will fail to completely remove such accumulation.

Various devices have been proposed which wash the hulls of boats while the boat remains in the water. This class of devices, while interesting as they relate to the harm which may be experienced by boat hulls from accumulation of contaminating materials thereon, are not applicable to the present invention. Typically devices in this class of inventions rely upon rotating brushes to clean the hull of the boat under treatment while moving along and under the boat while the boat remains in the water.

Various devices have been proposed which wash the hulls of boats subsequent to complete removal of the boat from a body of water. Many of these devices manipulate brushes, or other objects, in combinations with an introduction of water to clean the portion of the boat hull under treatment. It has been proposed to utilize water dispersing discharges, typically in a form and velocity commonly referred to as 'pressure cleaning', which act alone to provide the desired cleaning of the boat hull. Typically the water dispersing discharge location(s) are mechanically moved about relative to the stationary boat hull. Often devices in this class are utilized during a transfer procedure and positioned on a piece of equipment between the body of water and a fixed storage location, such as in a multiple boat storage rack at a marina.

The most common variety of boat lifts which will benefit from the present invention are those which slowly transfer the boat back and forth between the elevated storage position and the lowered launch/retrieve position. While wide variation between models exist, typically such transfers are on the order of five (5) to ten (10) minutes for each lowering operation and each raising operation. Many configurations of boat lifts exist which may function with the present invention. A common type is a straddling type which has at least four (4) stationary corner posts with the boat cradle positioned therebetween and engaged by at least four (4) vertically oriented elevation manipulation members. Typically, these vertically oriented elevation manipulation members are mere cables which are secured to the boat cradle at one end and to the fixed portion of the boat lift for displacement, most commonly via a winding process, at the opposing end. Another common type is a single side rail type boat lift which has the boat cradle extending outward therefrom generally parallel to the surface of the water. Often the fixed rail portion will be angularly offset relative to perpendicular to the surface of the water. These types of boat lifts will often be installed in the absence of decking, at least on the far side of the boat lift from the shore. These types of boat lifts are typically deployed with smaller lighter boats. These types of boat lifts present unique challenges for the boater who wishes to rinse down the boat hull following use. This challenge is primarily related to the lack of ready access to the offshore side of the boat lift. Another method of lifting a boat out of the water is by a pair of davits mounted on the shore using cables attached to the bow and stern of the boat. This also leaves the offshore side of the boat unavailable for cleaning. The present invention can be easily adapted to these lifts via posts or pilings mounted in the body of water on the side of the hull away from the landside. A plurality of fresh water discharges can then be attached to the pilings with water supplied from landside together with a plurality of fresh water discharges on the landside.

The present invention is primarily intended to be deployed with a dedicated boat lift which is conventionally utilized to store, in an elevated dry condition, a single boat and to launch and retrieve that boat from a body of water. Various devices have been proposed to wash the boat hull, and incidentally the boat cradle of the boat lift, subsequent to full elevation of the boat lift to a storage position. These devices universally utilized mechanically features which move about at least horizontally during performance of the cleaning procedure, such as moving rotating brushes from stem to stern while dispensing water. These devices are extremely complicated in design, expensive to install and maintain and time consuming to operate. Many users do not like to leave their boating equipment unattended during operation of such mechanical devices. This includes during operation of the boat lift and during operation of the hull cleaning machinery. Therefore, when operating the known boat hull cleaning devices which operate only on fully elevated and stationary boats the user will stay during the raising of the boat from the landing position to the elevated storage position and during operation of the boat hull cleaning device. Wide variations in operating time exist, depending upon design, for operation of these conventional boat hull cleaning devices. An example of time of operation for such devices is five (5) to ten (10) minutes. Therefore, a complete conventional 'from initial landing orientation to proper elevated and washed storage orientation' for a boat will consume the time for the raising operation of the boat lift, typically five (5) to ten (10) minutes, and the time for the washing operation, commenced only when the raising operation is fully complete, typically another five (5) to ten (10) minutes. In the instances when a boat is only being removed for a brief period of time, such as overnight, the user will often forego the cleaning operation which leaves contaminates thereon which then have an opportunity to dry and harden on the boat hull of the boat.

An excellent example of the state of the art in boat hull cleaning is depicted in U.S. Pat. No. 5,445,101 issued to Leonard Koch. This reference teaches positioning of water piping, having a multiplicity of holes directed generally upward, in fixed attachment on the boat cradle below the contact points between the boat cradle and the hull of the boat positioned thereon. The water piping is then lowered into the body of water each time the boat cradle is lowered into the body of water. Fresh pressurized rinsing water is then discharged through the water piping and the multiplicity of holes to spray upward onto the boat hull to rinse the boat hull, after the water piping has been elevated above the surface of the body of water. This patent is primarily adapted to pontoon boats and other doubled hulled vessels and require an elaborate design of pipes unique to a particular type boat. These spray pipes are then attached to that part of the lift where the boat sets as it is raised and lowered to and from the body of water. The fresh pressure water is supplied via flexible hoses.

Various deficiencies exist with each of the proposed methods of maintaining the hulls of boats in a generally clean generally contamination free state while elevated above a body of water in a storage orientation on a boat lift. These attempts have been less efficient than desired. As such, it may be appreciated that there continues to be a need for a simple method of rinsing a hull of a boat during a raising of the boat out of a body of water utilizing a boat lift where the rinsing removes as much contaminating material as possible from the boat hull during the time of the actual raising of the boat. The present invention substantially fulfills these needs.

SUMMARY

In view of the foregoing disadvantages inherent in the known types of boat hull washing devices, your applicant has devised a method of fresh water rinsing the boat hull during a removal of the boat from a body of water utilizing a boat lift. The method has the steps of providing a boat lift having a boat cradle, providing a plurality of fresh water discharges, elevationally displacing the boat on the boat cradle and discharging fresh water from each of the discharge locations during at least a portion of the elevational displacement of the boat. The boat lift has a fixed portion and the boat cradle with the boat cradle elevationally displaceable by the boat lift relative to the fixed portion. The boat cradle engages the hull of the boat for gravity biased retention of the boat on the boat cradle during a removal of the boat from the body of water. The boat lift has means to elevationally displace the boat out of the body of water and into the body of water. The plurality of provided fresh water discharges are attached relative to the fixed portion of the boat lift and positioned facing inward on opposing sides of the boat when the boat is positioned on the boat lift. Each fresh water discharge location is generally restricted to a fixed elevational position relative to the fixed portion of the boat lift. During the elevational displacing of the boat cradle to remove the boat from the body of water the discharging of the fresh water from each of the fresh water discharge locations occurs. This provides for fresh water to make contact with all surfaces of the hull generally from the deck line of the boat downward during the elevational displacement of the boat to rinse the boat hull to remove water from the body of water deposited on the boat hull.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a simple method of rinsing a boat hull of a boat during an elevational displacement of the boat utilizing a boat lift from a lowered launching/landing position in a body of water to a raised storage position above the body of water.

Other objects include;

a) to provide for the rinsing of the boat hull to occur routinely each and every time that the boat lift is operated to raise the boat out of the body of water.

b) to provide for the rinsing of the boat hull to occur without extending an operational time beyond that consumed by the raising operation of the boat lift.

c) to provide for an elevationally fixed positioning of the fresh water discharges where the boat moves upward relative to the fresh water discharges during the raising of the boat by the boat lift where the surfaces to be rinsed pass through a radially disposed rinsing plane.

d) to provide for a generally horizontally fixed positioning of assemblies of the fresh water discharges relative to the fixed portion of the boat lift where the assemblies of the fresh water discharges remain generally stationary and do not move significantly forward or back along the boat and do not move significantly toward or away from the boat during operation.

e) to provide for each of the fresh water discharges to oscillate repetitively within a respective angle of discharge many times during each raising operation of the boat to insure adequate coverage of the respective portion of the boat hull within the respective angle of discharge.

f) to provide for each of the fresh water discharges to oscillate within the respective angle of discharge with each pass through the respective angle of discharge consisting of a series of steps.

g) to provide for each of the series of steps through the respective angle of discharge of each of the respective fresh water discharges to have an impacting burst of a stream which may impact a location on the boat hull to maximize contamination removal at the respective location and adjacent areas.

h) to provide for a top to bottom rinsing of the boat hull where rinsing runoff assists in a cleaning of surfaces below a point of contact with the rinsing fresh water application.

i) to provide for each of the fresh water discharges to also utilize a conventionally known sprinkler type head as used to dispense a stream of water in a repetitive cycle in a series of steps across a definable angle of discharge.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION

Figure 1:
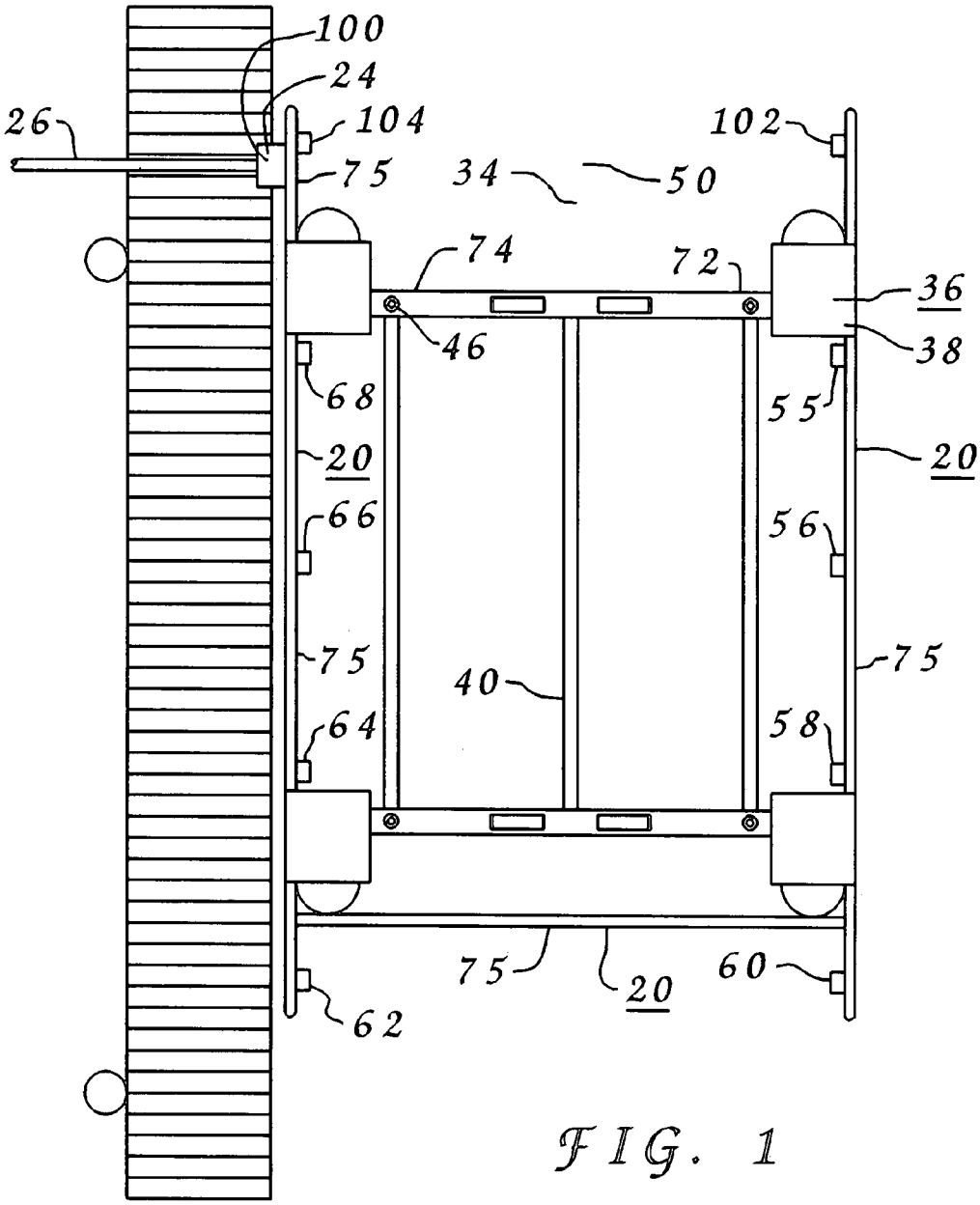
FIG. 1 is a top plan view of a dock having a boat lift with a boat hull rinsing device installed relative to the boat lift.

Many different boat hull rinsing devices having features of the present invention are possible. The following description describes the preferred embodiment of select features of those boat hull rinsing devices and various combinations thereof. These features may be deployed in various combinations to arrive at various desired working configurations of boat hull rinsing devices.

Reference is hereafter made to the drawings where like reference numerals refer to like parts throughout the various views.

The term fresh water as used herein has two (2) meanings depending upon the context in which it is used. In the context of referring to a body of water as fresh water the term is intended to distinguish it from a salt water body of water. In this context fresh water does not imply a lack of contamination and materials within the fluid which may coat and accumulate on objects, such as a boat hull of a boat. In the context of fresh water as a rinsing medium used with the present invention the fluid referred to as fresh water will be relatively free of contaminates. The fresh water as a rinsing medium can be centrally provided drinking water, water provided from a well, filtered water drawn from a suitable water source, centrally provided partially treated water intended for irrigation purposes, primarily lawn watering but not drinking, or some other suitable relatively clean source of water. The optional addition of a cleaning solution to the fresh water supply by some means prior to rinsing may be possible if required.

The term contamination as used herein refers to a very wide spectrum of materials, both organic and inorganic. Contamination may involve living matter, either in fresh water or salt water, which may attach itself to surfaces of the boat hull. Contamination may involve naturally occurring elements as well as man made, or refined, elements which may attach to the surfaces of the boat hull.

The term fresh water discharge as used herein refers to any structural configuration which has a fresh water supply and means to discharge the fresh water in some predefined dispersal pattern under at least modest pressure suitable for the rinsing required by the present invention.

Figure 2A:
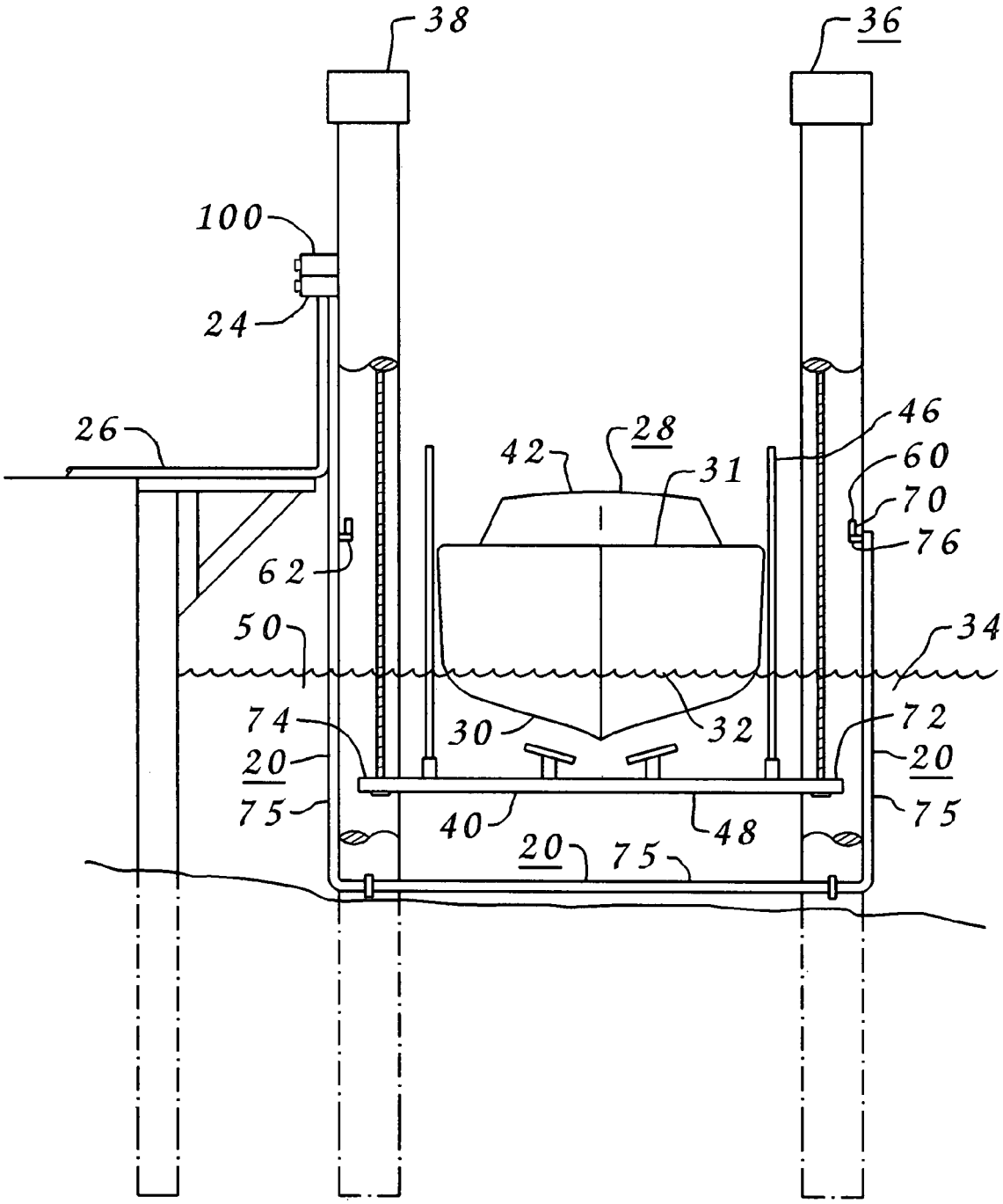
FIG. 2*a* through FIG. 2*e* are end elevational views of the dock, boat lift and boat hull rinsing device shown in FIG. 1, with the mid sections of the forward most major pilings cutaway to more fully illustrate the components therebehind, and with the addition of a boat, and in various positional orientations during transfer of the boat lift between a standard loading unloading lowered elevational position, FIG. 2*a*, and the boat in a storage orientation on the boat lift, FIG. 2*e*.

Referring now specifically to FIG. 1 through FIG. 3*b*, a boat hull rinsing device 20 has a plurality of fresh water discharges, fresh water discharge 60 depicted as an embodiment used to explain various preferred features of the present invention, and means to commence and terminate discharge, in the form of a control panel 24, see FIG. 2*a*. Boat hull rinsing device 20 is supplied with fresh water from any suitable source, such as municipal water supply line 26. While many fresh water supplies will arrive under suitable pressure for discharge for use with the present invention, a dedicated pressure creation device, such as a water pump, may be provided, if required. When water is drawn from a water source which is not as free of contamination as desired, filtering of the water may occur to bring it to a suitable purity.

Boat 28, of any applicable design, will have a hull 30 with a deck 31 positioned above hull 30, see FIG. 2*a*. On applicable boats not having a deck a gunwale, defining the top edge of the side of the boat, will be considered to be the equivalent of a locational position of the deck. Hull 30 has a hull water line 32 where boat 28 routinely rests in a body of water 34. The boat is merely a workpiece which is acted upon by the invention.

Boat hull rinsing device 20 will operate with a boat lift 36, specifically see FIG. 1 and FIG. 2*a*, of any applicable design. Boat lift 36 will have a fixed portion 38 and a boat cradle 40. Fixed portion 38 of boat lift 36 will comprise those portions which are generally restricted to a single elevational orientation during operation of boat lift 36. Boat cradle 40 will comprise those portions which are elevationally displaced during operation of boat lift 36 to lower or raise boat 28. The boat lift is merely a workpiece which is acted upon by the invention.

The term boat cradle includes those portions of the boat lift which are elevationally displaced during operation of the boat lift, including any supporting cables or members, if present, and is not limited to those portions which contact the boat.

Figure 2B:
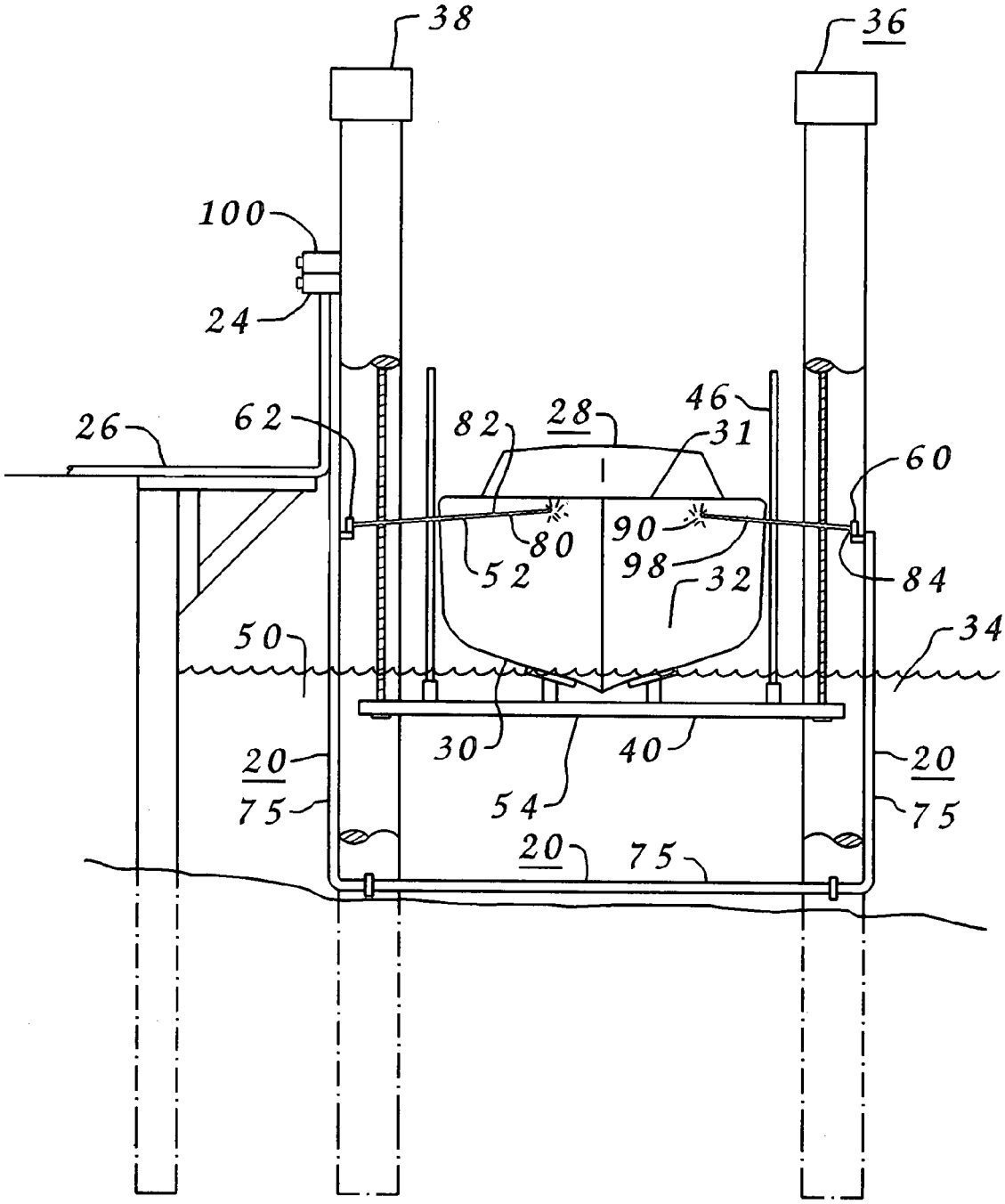
Figure 2C:
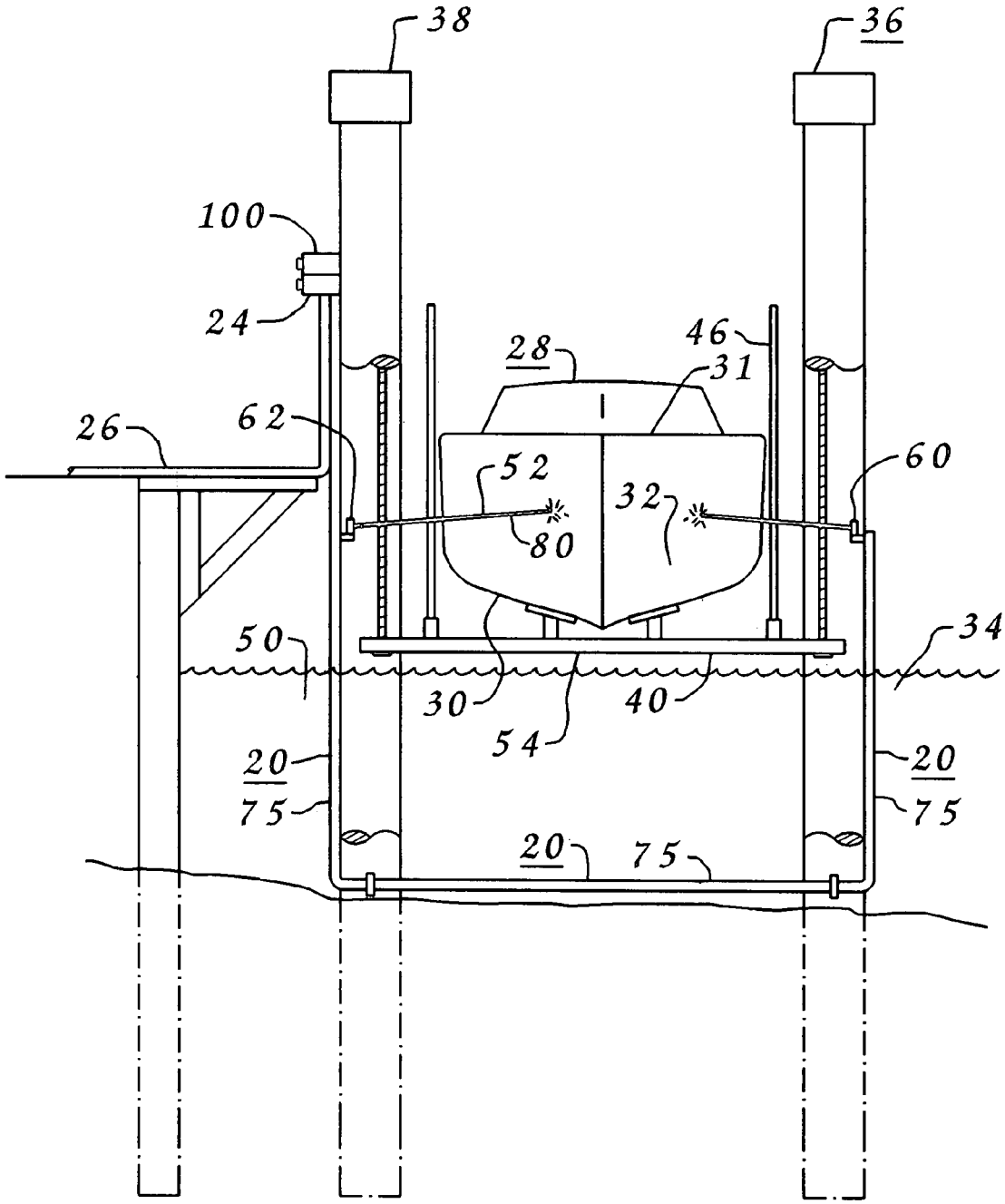
Figure 2D:
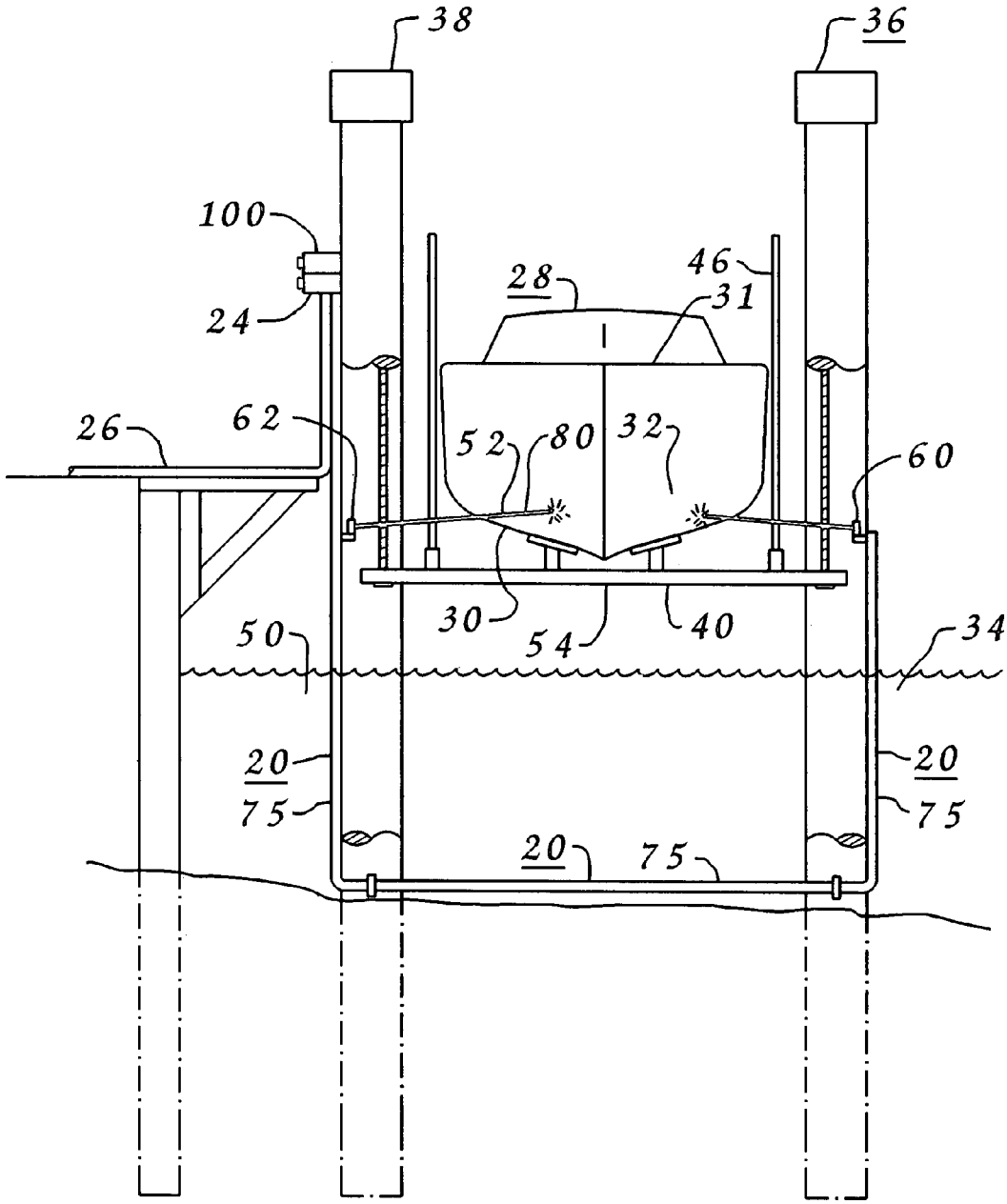
Figure 2E:
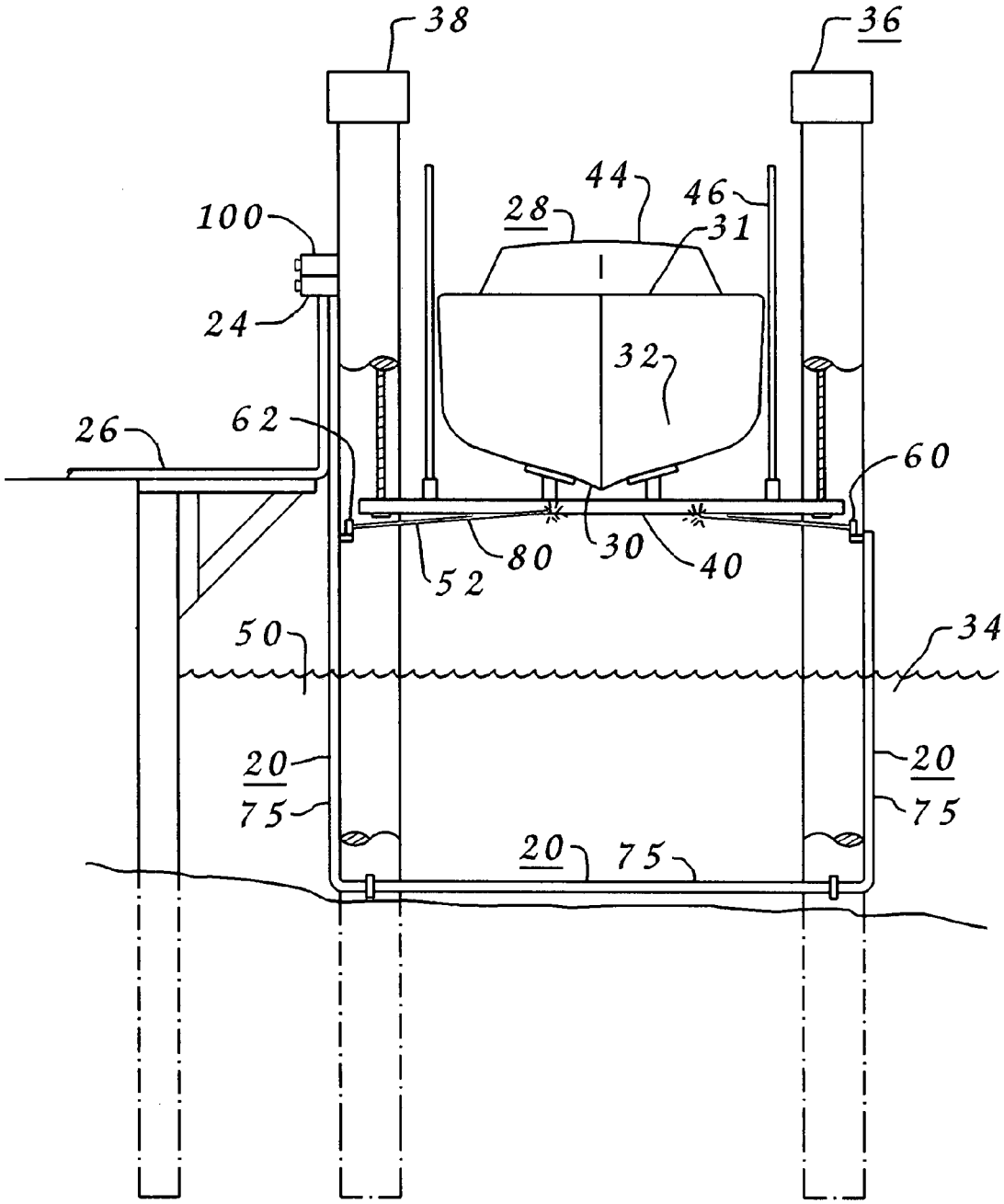

Boat lift 36 is routinely used to transfer boat 28 from a floating orientation 42 in body of water 34, see FIG. 2*a*, to a storage orientation 44, see FIG. 2*e*. Boat lift 36 is also routinely used to transfer boat 28 from storage orientation 44 to floating orientation 42. Various vertically oriented guide poles 46 extend upward from boat cradle 40 to assist the boater in properly positioning boat 28 relative to boat lift 36.

While boat 28 is within body of water 34, see FIG. 2*a*, contamination 50 from body of water 34 may become present on at least hull 30 of boat 28. When boat 28 is positioned on boat cradle 40 and is raised out of body of water 34 utilizing boat lift 36 it is desirable to rinse as much contamination 50 off of hull 30 as possible.

Boat hull rinsing device 20 operates, in cooperation with operation of boat lift 36, to provide for rinsing 52 of a portion of hull 30 of boat 28 from above hull water line 32, and preferably from or near deck 31, downward, see FIG. 2*a*. Boat hull rinsing device 20 will also provide for rinsing 52 of a portion of boat cradle 40. Rinsing 52 generally occurs during raising elevational displacement 54 of boat cradle 40, see elevational changes from FIG. 2*a* through FIG. 2*e*.

Figure 3A:
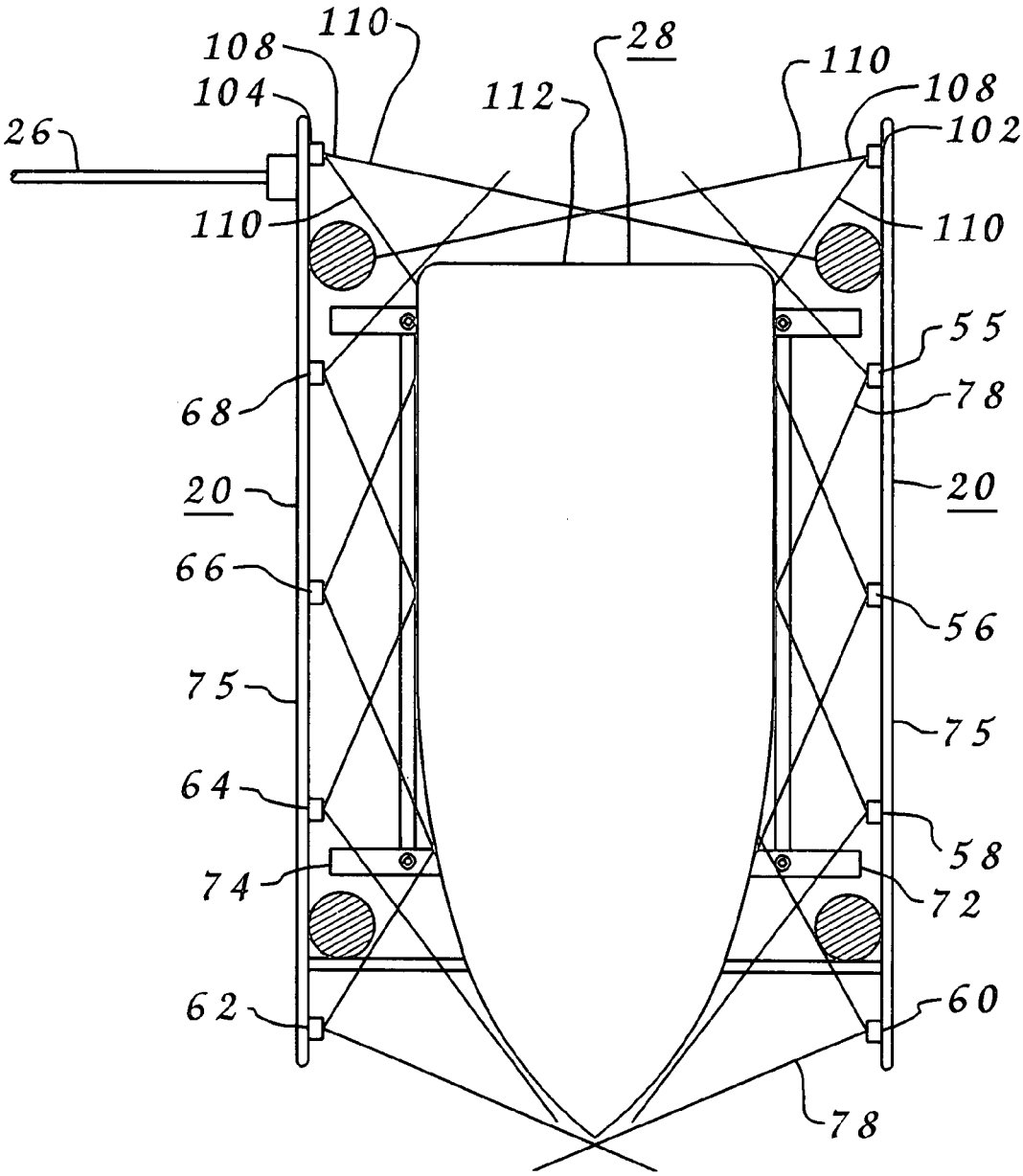
FIG. 3*a* is a top plan view of the boat hull rinsing device, select portions of the boat lift and the boat and showing depictions of various angles of discharge from the various fresh water discharges, the upper portions of the major pilings and certain higher structures of the boat lift have been removed, including the cables, to more fully illustrate the invention.
Figure 3B:
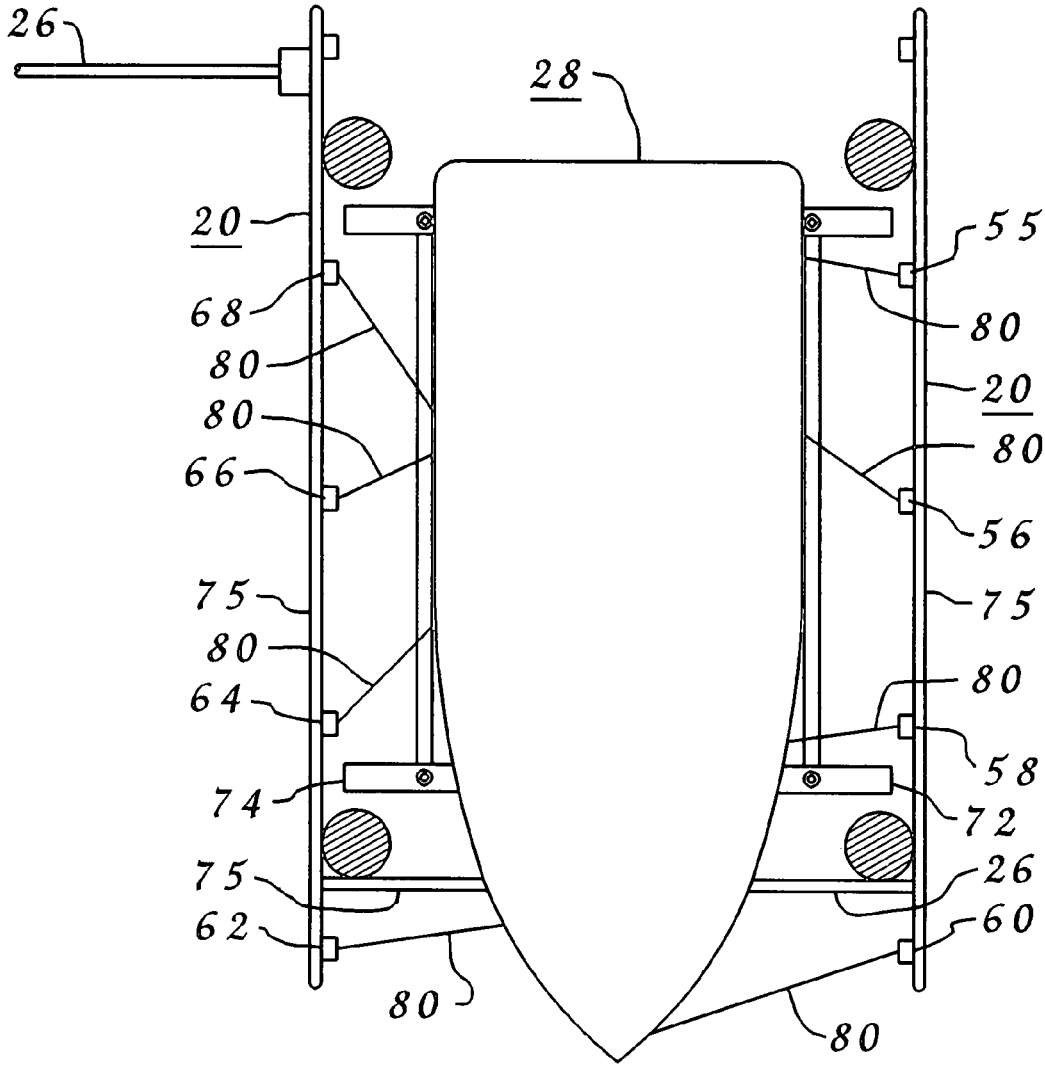
FIG. 3*b* is a top plan view of depiction of FIG. 3*a* with representations of various directed streams from the various fresh water discharges during their respective cycles.
Figure 4:
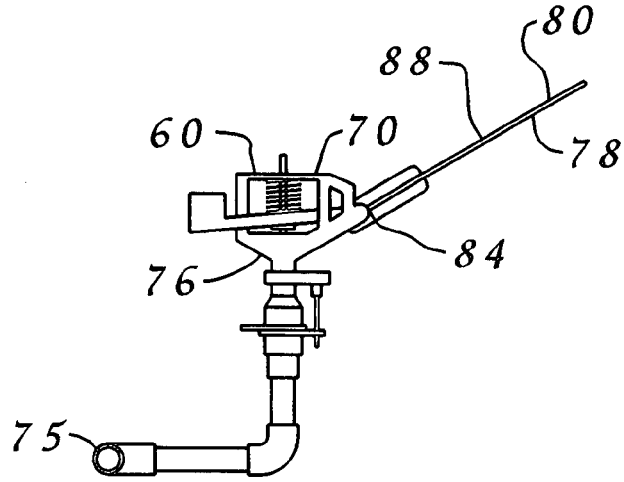
FIG. 4 is an elevational view of a sprinkler type head.
Figure 5A:
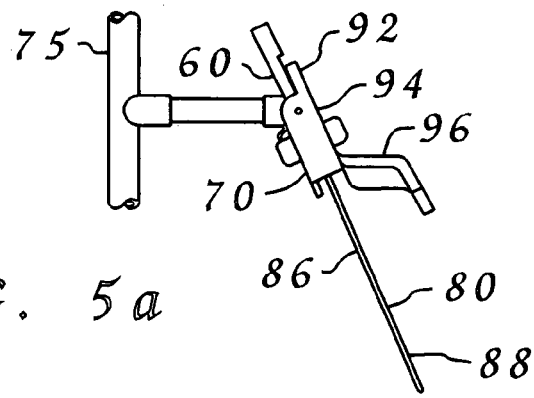
FIG. 5*a* through FIG. 5*f* are top plan views depicting a series of steps during oscillation of the sprinkler type head depicted in FIG. 4 through an angle of discharge.
Figure 5B:
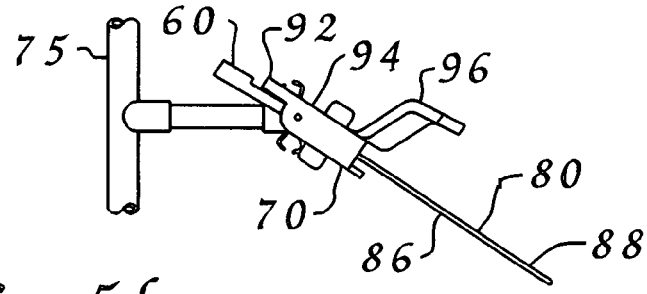
Figure 5C:
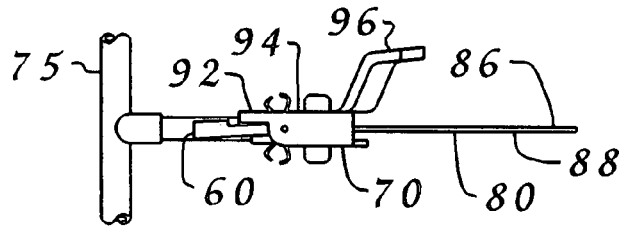
Figure 5D:
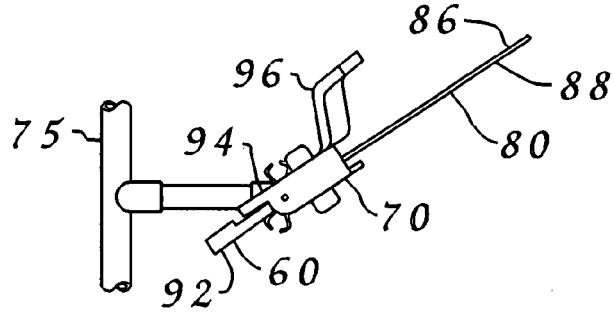
Figure 5E:
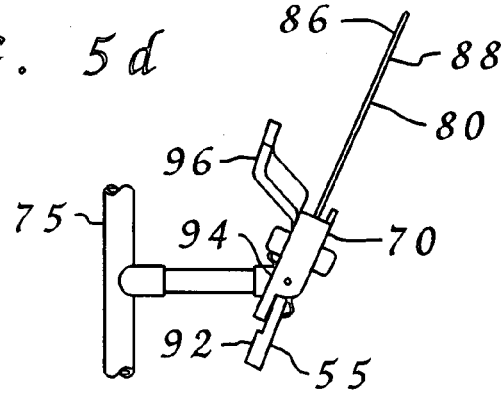
Figure 5F:
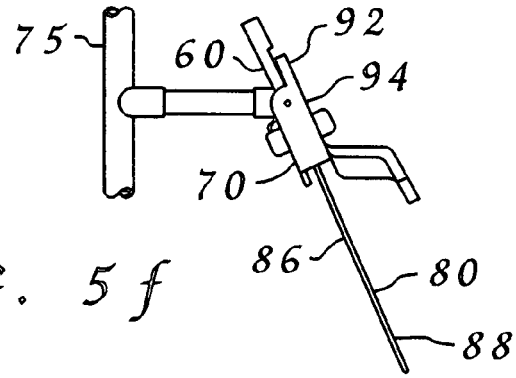

Referring now specifically to FIG. 1, FIG. 3*a* and FIG. 3*b*, a plurality of fresh water discharges 55, 56, 58, 60, 62, 64, 66, 68, 102 and 104 are positioned on opposing sides 72 and 74 of boat cradle 40 of boat lift 36. Each fresh water discharge 55, 56, 58, 60, 62, 64, 66, 68, 102 and 104 is supplied with fresh water via a water supply conduit 75 utilizing fresh water supplied from municipal water supply line 26. Each fresh water discharge 55, 56, 58, 60, 62, 64, 66, 68, 102 and 104 is positioned at a respective fixed elevation, such as fixed elevation 76 for fresh water discharge 60, see FIG. 2*b* and FIG. 4, relative to fixed portion 38 of boat lift 36. In certain installations all deployed fresh water discharges will be positioned at a common elevation relative to fixed portion 38 of boat lift 36. In certain installations at least some of the deployed fresh water discharges will be positioned at unique elevations relative to fixed portion 38 of boat lift 36. A fresh water discharge may be positioned along a center line of boat lift 36 to rinse a forward portion of hull 30 on opposing sides of a center line of boat 28. Typically the number of deployed fresh water discharges will be dependent upon the length of the specific boat to be washed.

Each fresh water discharge will be directed generally toward boat 28 when positioned on boat lift 36. Preferably each fresh water discharge will have means to distribute fresh water within a respective angle of discharge, such as angle of discharge 78 for fresh water discharge 60, see FIG. 3*a*. In these instances certain directional discharges, at least at the opposing ends of angle of discharge 78, may not be directed toward boat 28 when positioned on boat cradle 40 and at certain elevational orientations. When boat 28 is fully elevated to storage orientation 44, see FIG. 2*e*, hull 30 may be above the path of discharge of directed stream 80.

Control panel 24, see FIG. 1 and FIG. 2*a*, the means to commence and terminate discharge and control the cradle movement, activates the discharge of fresh water from fresh water discharges 55, 56, 58, 60, 62, 64, 66, 68, 102 and 104 during raising elevational displacement 54 of boat 28 out of body of water 34 utilizing boat lift 36. Control panel 24 also deactivates the discharge of fresh water from fresh water discharges 55, 56, 58, 60, 62, 64, 66, 68, 102 and 104 at, or near, the termination of raising elevational displacement 54 of boat 28 out of body of water 34 utilizing boat lift 36. If desired this activation and deactivation occurs at generally the same time that boat lift 36 is activated and deactivated to raise boat cradle 40. This provides for fresh water to be discharged during at least a portion of raising elevational displacement 54 of boat 28 out of body of water 34 utilizing boat lift 36. Runoff of the fresh water dispersed by the present invention from surfaces of the boat hull and of the boat cradle, enhance the rinsing operation.

It is possible to provide for each, or select, fresh water discharges to disperse a directed stream 80 of water or to provide for some divergence of the flow. A divergence of the flow, or scattering of the water into a multitude of droplets, can provide for a very thorough rinsing action. In the embodiment depicted each fresh water discharge further comprises directed stream 80 of fresh water during operation of boat hull rinsing device 20. Each directed stream 80 of fresh water maintain a tight containment 82 from a discharge point 84, see FIG. 2*b* and FIG. 4, from fresh water discharge to contact with hull 30 of boat 28 or to contact with boat cradle 40 of boat lift 36. As mentioned elsewhere herein each fresh water discharge ideally will oscillate repetitively through a respective angle of discharge 78, see FIG. 3*a*. In certain situations angle of discharge 78 will result in directed stream 80 entirely missing making contact with boat 28 or boat cradle 40 of boat lift 36. This passing of possible contact points ensures that all surface intended to be rinsed by a respective fresh water discharge actually are rinsed by the present invention.

Referring generally now to FIG. 4 and FIG. 5*a* through FIG. 5*f*, each directed stream 80 of water preferably is further broken down into a series 86 of intermittent bursts 88 where a multiplicity of fluid impacts 90, see FIG. 2*b*, occur on hull 30 of boat 28 and on boat cradle 40 of boat lift 36. By providing a very large number of fluid impacts 90, which will each provide a dislodging effect to any stubborn contamination present upon the impacted surface, a thorough rinsing and cleaning is ensured. Another benefit of each fluid impact 90 is the splashing effect which distributes fresh water to hidden surfaces which are not in a direct line of rinsing of any of the various directed streams. Examples of such hidden surfaces include those on boat cradle 40 which are facing hull 30. It being understood that the beneficial splashing will occur with spraying of a less contained stream of fresh water than that of directed stream 80.

Many devices have been proposed, primarily in the lawn irrigation field, to distribute water in radial patterns, or in partial radial patterns, from a pivotal anchoring axis. Many of these prior art devices may be used directly with the present invention, or may be easily modified to be used with the present invention.

In the embodiment depicted, referring again to FIG. 4 and FIG. 5*a* through FIG. 5*f*, a sprinkler type head 70, a commercially available lawn watering device, acts as each of the deployed fresh water discharges. Sprinkler type head 70, as conventionally known in the art, has features to perform motion functions utilizing water flowing therethrough. Sprinkler type head 70 provides for dispensing of stream of fresh water while oscillating 92 through angle of discharge 78. Oscillation 92 occurs in a repetitive cycle 94. Each pass through angle of discharge 78 occurs in a series of steps 96 where directed stream 80 is broken down into intermittent bursts 88. Sprinkler type head 70 is ideally suited for use with the present invention as it provides ideal fresh water distribution coverage in a preferred coverage mode. Sprinkler type head 70 is also simple to adjust subsequent to installation, does not require any maintenance and, if damaged, may be replaced by most users having novice level plumbing skills. It being understood that many, very many, cycles through each respective angle of discharge occur for each fresh water discharge during the raising elevational displacement of the boat cradle.

Sprinkler type head 70 also has an elevational angle of discharge 98, see FIG. 2*b*, which projects directed stream 80 upward slightly. Sprinkler type head 70, as conventionally known in the art, has features which permit adjustment of elevational angle of discharge 98 to a desired orientation. A slightly upward projection is ideally suited to the rinsing of hull 30 as elevational angle of discharge 98 is complementary to the slope of many boat hulls. Each fresh water discharge may be provided with a similar elevational angle of discharge which complements the corresponding contour of the specific boat hull to be cleaned.

Referring now to FIG. 3*a*, preferably a sufficient number of fresh water discharges will be provided to permit a significant overlapping of adjacent angle of discharges 78 on each of the two (2) side of the boat lift. Each angle of discharge 78 of adjacent pairs of fresh water discharges on a respective side 72 or 74 of boat cradle 40 overlap significantly at a closest contact point on hull 30. Ideally, such overlap provides for each area on boat 28 to be contacted by fresh water discharged from two (2) fresh water discharges.

Control panel 24, specifically see FIG. 1 and FIG. 2*a*, has means to commence fresh water discharge which is synchronized to commence fresh water discharge automatically at a commencement of operation of boat lift 36 to raise boat cradle 40. Control panel 24 has means to terminate fresh water discharge which is synchronized to terminate fresh water discharge automatically at a termination of operation of boat lift 36 to raise boat cradle 40. Override means acts to prevent fresh water discharge during a select raising elevational displacement of boat 28 out of body of water 34 utilizing boat lift 36. This override of the rinsing operation may be rarely utilized. Control panel 24 may be provided with this feature, mere shutoff of the supply of fresh water may provide this feature or some other arrangement may provide this feature.

Control panel 24 has a user input 100, see FIG. 1 and FIG. 2*a*, to provide for operational override means to deliberately pause operation of boat lift during raising elevational displacement. One example of such pausing of the raising operation involves prolonging the time span required to perform the raising operation at a specific location, such as at hull water line 32, which may require additional rinsing to properly clean. This pausing of operation provides for a more thorough rinsing operation to occur due to the longer time span of operation of boat hull rinsing device 20 during the raising of boat 28. Examples of when such longer, and more thorough, rinsing operations might be performed include when the boat to be washed has spent a particularly long period of time in the body of water and when the boater intends to store their boat for a particularly long period of time on the boat lift. Additionally the pausing of the raising operation permits the user to manually manipulate a wiping tool, such as a broom, to dislodge any particularly resistant contamination 50 from hull 30.

It is possible, if desired, to provide stationary wide dispersal fresh water discharges which merely sprays fresh water from a fixed elevation and in a single stationary directional orientation during raising of the boat cradle of the boat lift and the boat if positioned thereon. This is particularly desirable for the aft section, stern, of the boat to provide a rinsing of the surfaces of the aft of the boat and to those components of the engine and drive components, such as propeller, positioned thereat. Opposing fan fresh water discharges 102 and 104, see FIG. 1 and FIG. 3*a*, are provided and positioned on opposing sides 72 and 74 of boat cradle 40. Fan fresh water discharges 102 and 104 are positioned at a fixed elevational position relative to fixed portion 38 of boat lift 36. Fan fresh water discharges 102 and 104 are each directed generally toward boat cradle 40 of boat lift 36 for fixed stationary discharge 108 of fresh water in a fan shaped discharge orientation 110 on aft section 112 of boat 28. Control panel 24, see FIG. 2*a*, also provides for the means to commence and terminate fresh water discharge from fan fresh water discharges 102 and 104 during raising elevational displacement 54 of boat 28 out of body of water 34 utilizing boat lift 36. This provides for fresh water to be discharged from fan fresh water discharges 102 and 104 during at least a portion of raising elevational displacement 54 of boat 28 out of body of water 34 utilizing boat lift 36.

It is possible to provide control panel 24, see FIG. 2*a*, with wireless communication means, as conventionally known in the art. This provides for the boater to control boat hull rinsing device 20, and boat lift 36 if desired, while being spaced from control panel 24, including while in boat 28.

Preferably operation of boat hull rinsing device 20, as depicted in FIG. 1*a* through FIG. 1*e*, commence while boat 28 is still generally elevated out of body of water 34. It is possible to provide for such commencement to occur at any desired point during the raising of boat 28 utilizing boat lift 36. This is particularly desirable when the user desires the option of completely rinsing hull 30 during a partial lowering and raising operation of boat lift 36 without placing boat 28 into body of water 34. This partial lowering and raising operation then occurs without reintroducing contamination 50 from body of water 34 to hull 30. This arrangement is easily accomplished by elevational positioning of the deployed fresh water discharges in cooperation with a sufficiently high storage orientation 44 provided by boat lift 36.

Figure 6:
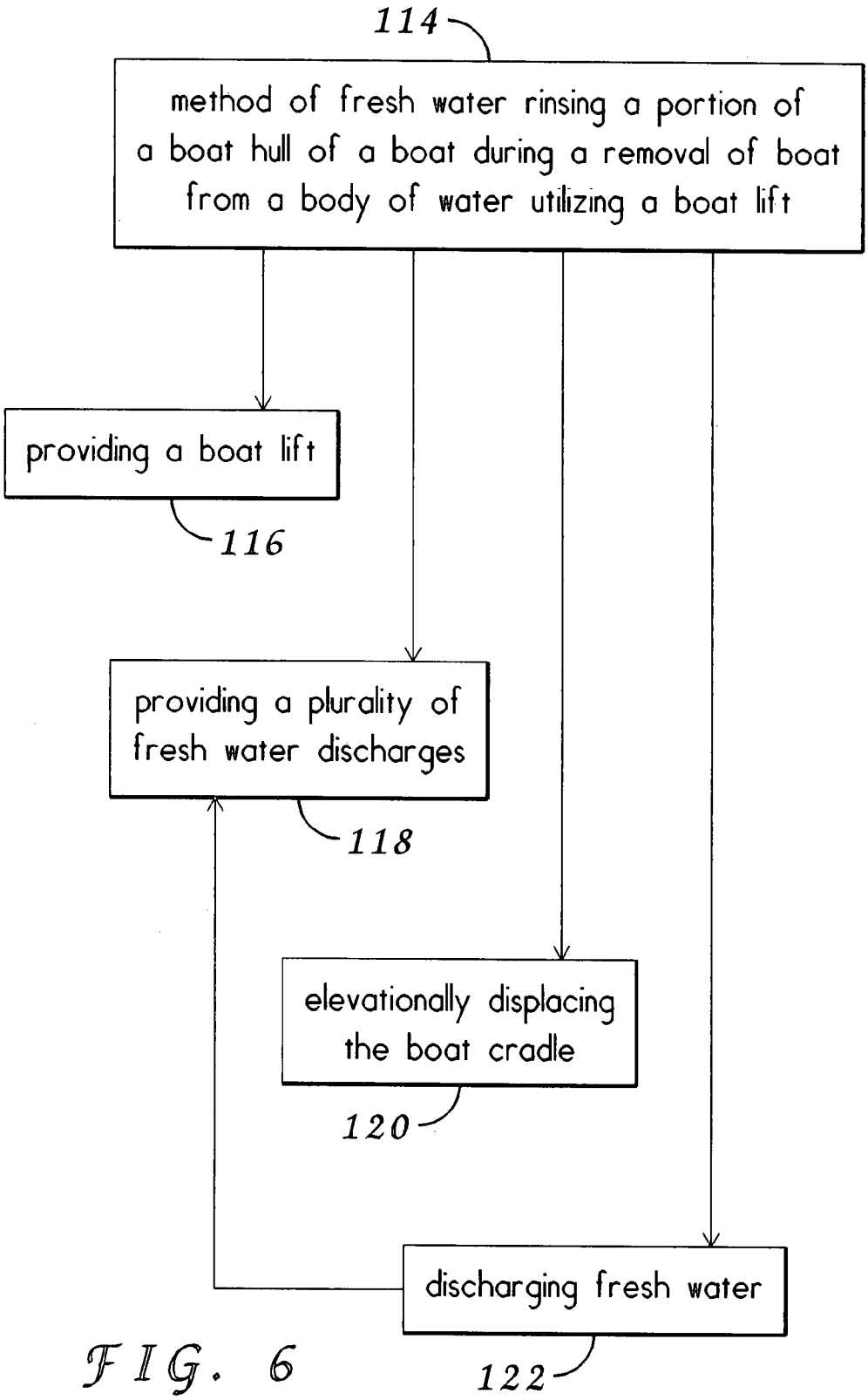
FIG. 6 through FIG. 14 are flow charts depicting features of the method.

Referring now to FIG. 6, a 'method of fresh water rinsing a portion of a boat hull of a boat during a removal of the boat from a body of water utilizing a boat lift' 114 is depicted. 'Method' 114 has the steps of 'providing a boat lift' 116, 'providing a plurality of fresh water discharges' 118, 'elevationally displacing the boat cradle' 120 and 'discharging fresh water' 122 from 'provided fresh water discharges' 118.

Figure 7:
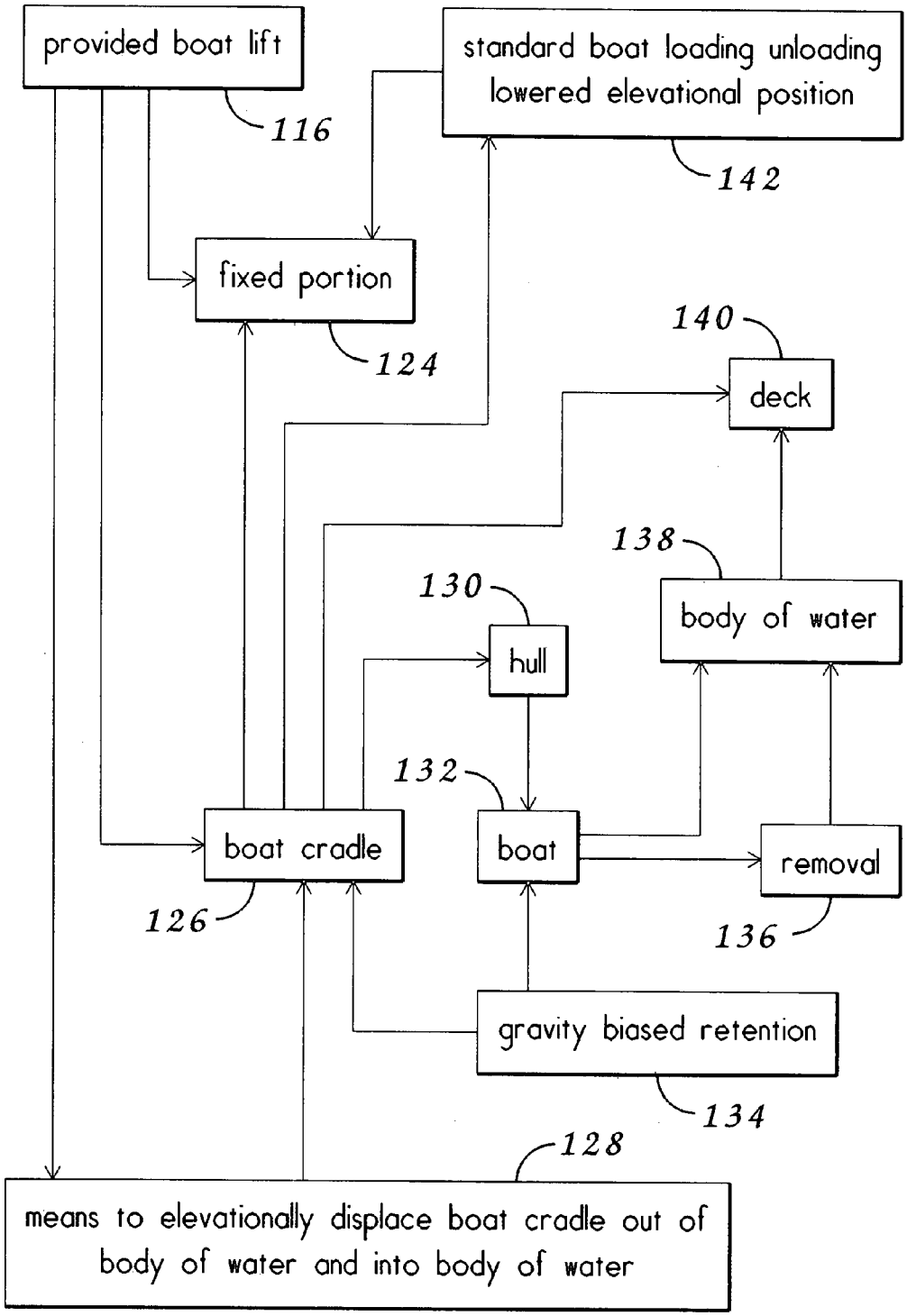

Referring now to FIG. 7, 'provided boat lift' 116 has a 'fixed portion' 124, a 'boat cradle' 126 and 'means to elevationally displace boat cradle out of body of water and into body of water' 128. 'Boat cradle' 126 is elevationally displaceable by 'provided boat lift' 116 relative to 'fixed portion' 124. 'Boat cradle' 126 engages a 'hull' 130 of a 'boat' 132 for 'gravity biased retention' 134 of 'boat' 132 on 'boat cradle' 126 during a 'removal' 136 of 'boat' 132 from a 'body of water' 138. 'Boat' 132 further has a 'deck' 140 positioned above 'hull' 130. 'Boat cradle' 126 of 'provided boat lift' 116 has a 'standard boat loading unloading lowered elevational position' 142 relative to 'fixed portion' 124 of 'provided boat lift' 116.

Figure 8:
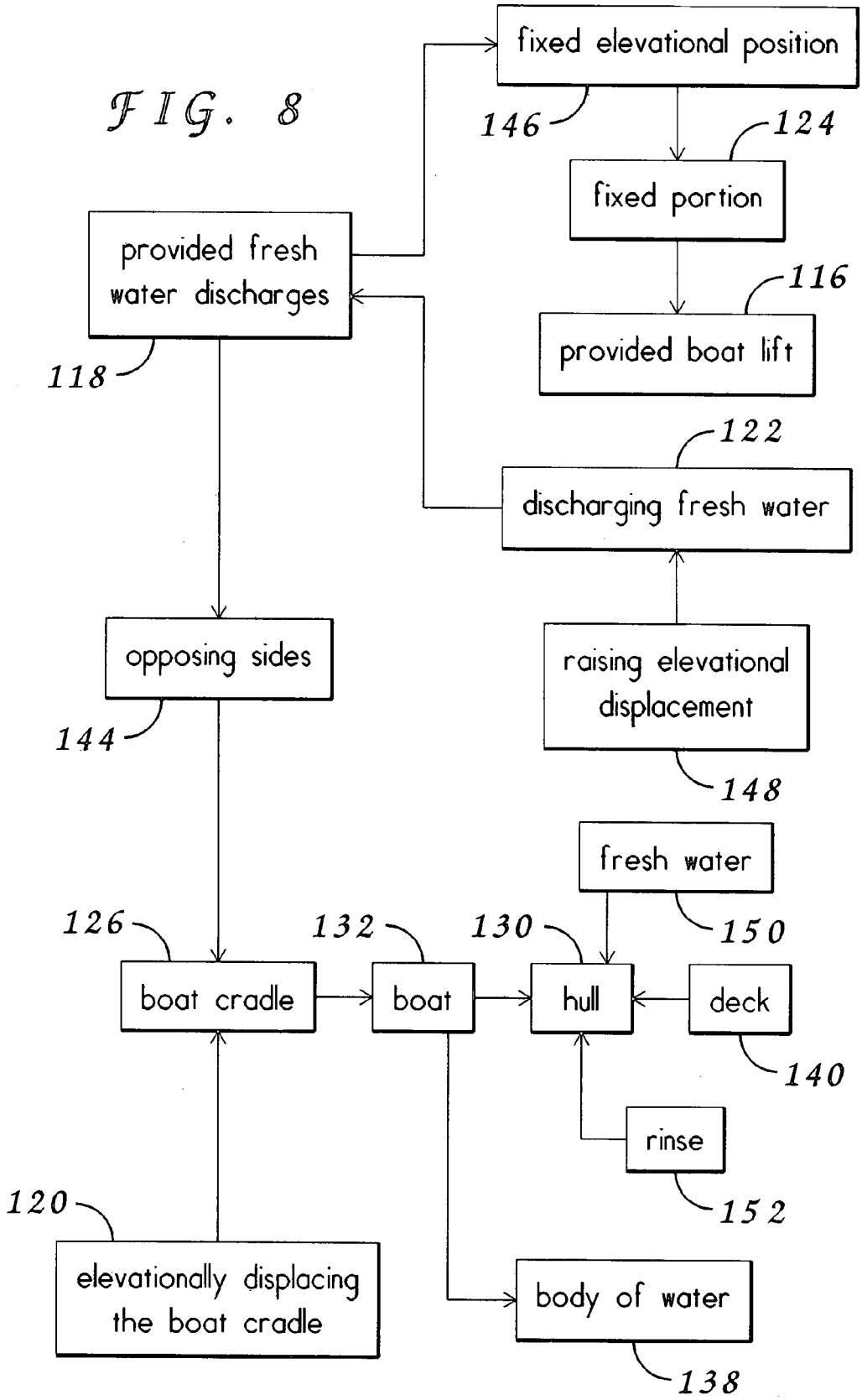

Referring now to FIG. 8, 'provided fresh water discharges' 118 are positioned on 'opposing sides' 144 of 'boat cradle' 126. Each 'provided fresh water discharge' 118 is generally restricted to a 'fixed elevational position' 146 relative to 'fixed portion' 124 of 'provided boat lift' 116. 'Elevationally displacing the boat cradle' 120 acts to remove 'boat cradle' 126 and 'boat' 132 positioned thereon from 'body of water' 138. 'Discharging fresh water' 122 occurs from each 'provided fresh water discharge' 118 during at least a portion of a 'raising elevational displacement' 148 of 'boat cradle' 126 where 'fresh water' 150 makes contact with a portion of 'hull'

130 of 'boat' 132 from 'deck' 140 downward during 'raising elevational displacement' 148 of 'boat cradle' 126 to 'rinse' 152 the portion of 'hull' 130 of 'boat' 132 below 'deck' 140 to remove water of 'body of water' 138 deposited on 'hull' 130.

Figure 9:
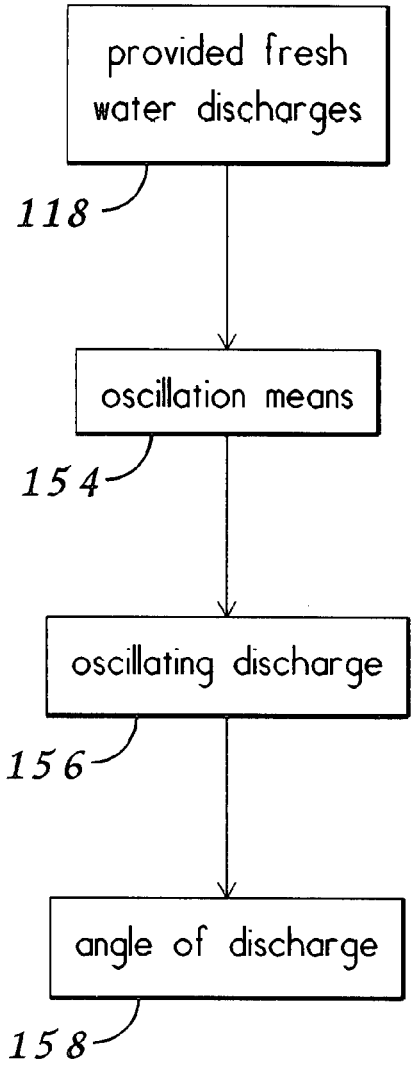

Referring now to FIG. 9, each 'provided fresh water discharge' 118 further comprises 'oscillation means' 154 to provide for 'oscillating discharge' 156 through an 'angle of discharge' 158.

Figure 11:
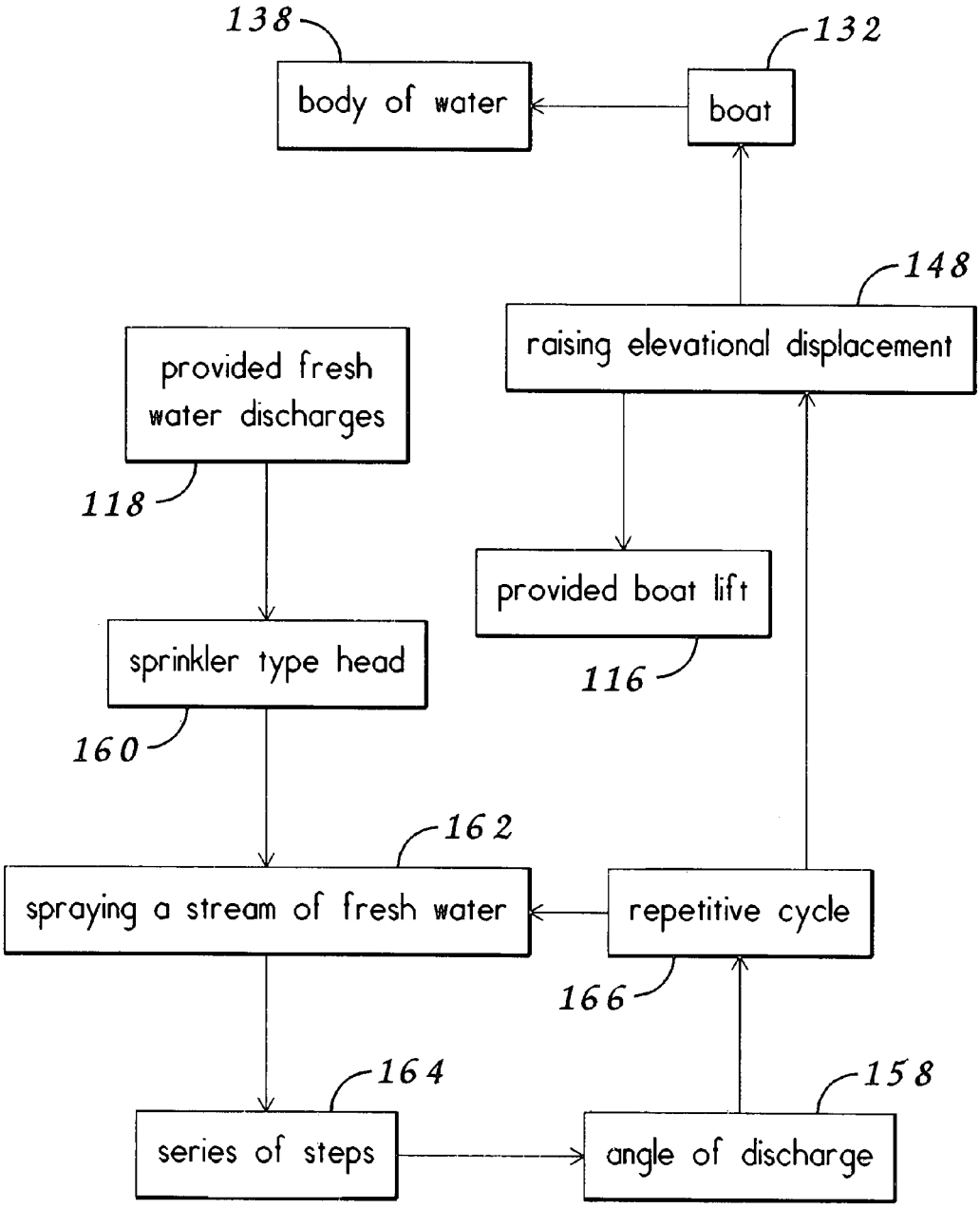

Referring now to FIG. 11, each 'provided fresh water discharge' 118 further comprises a 'sprinkler type head' 160 for 'spraying a stream of fresh water' 162 in a 'series of steps' 164 across 'angle of discharge' 158 in a 'repetitive cycle' 166 during 'raising elevational displacement' 148 of 'boat' 132 out of 'body of water' 138 utilizing 'provided boat lift' 116.

Figure 12:
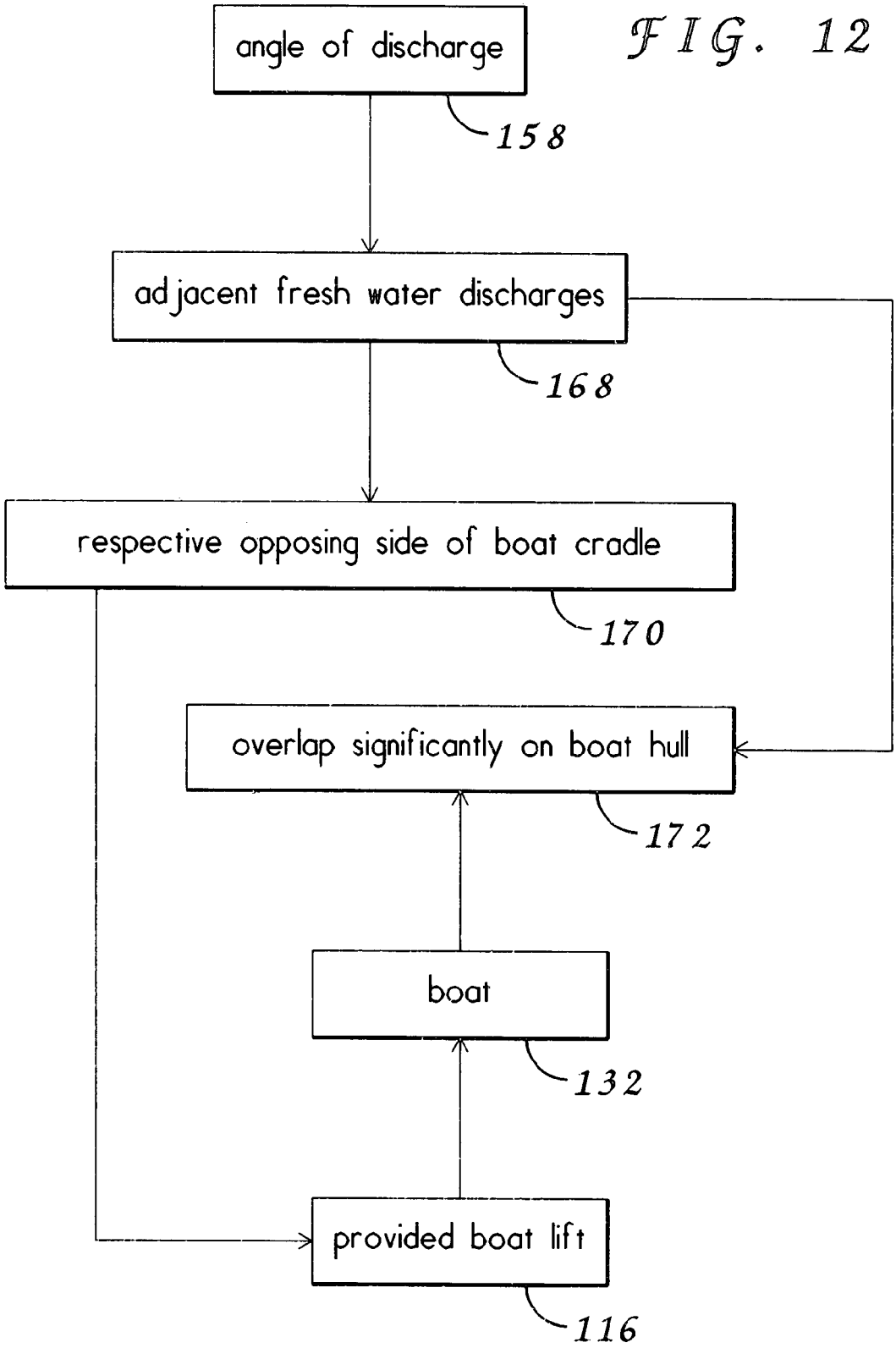

Referring now to FIG. 12, each 'angle of discharge' 158 of 'adjacent fresh water discharges' 168 on a 'respective opposing side of boat cradle' 170 of 'provided boat lift' 116 'overlap significantly on boat hull' 172 of 'boat' 132 positioned on 'provided boat lift' 116 at some point during operation of 'provided boat lift' 116.

Figure 13:
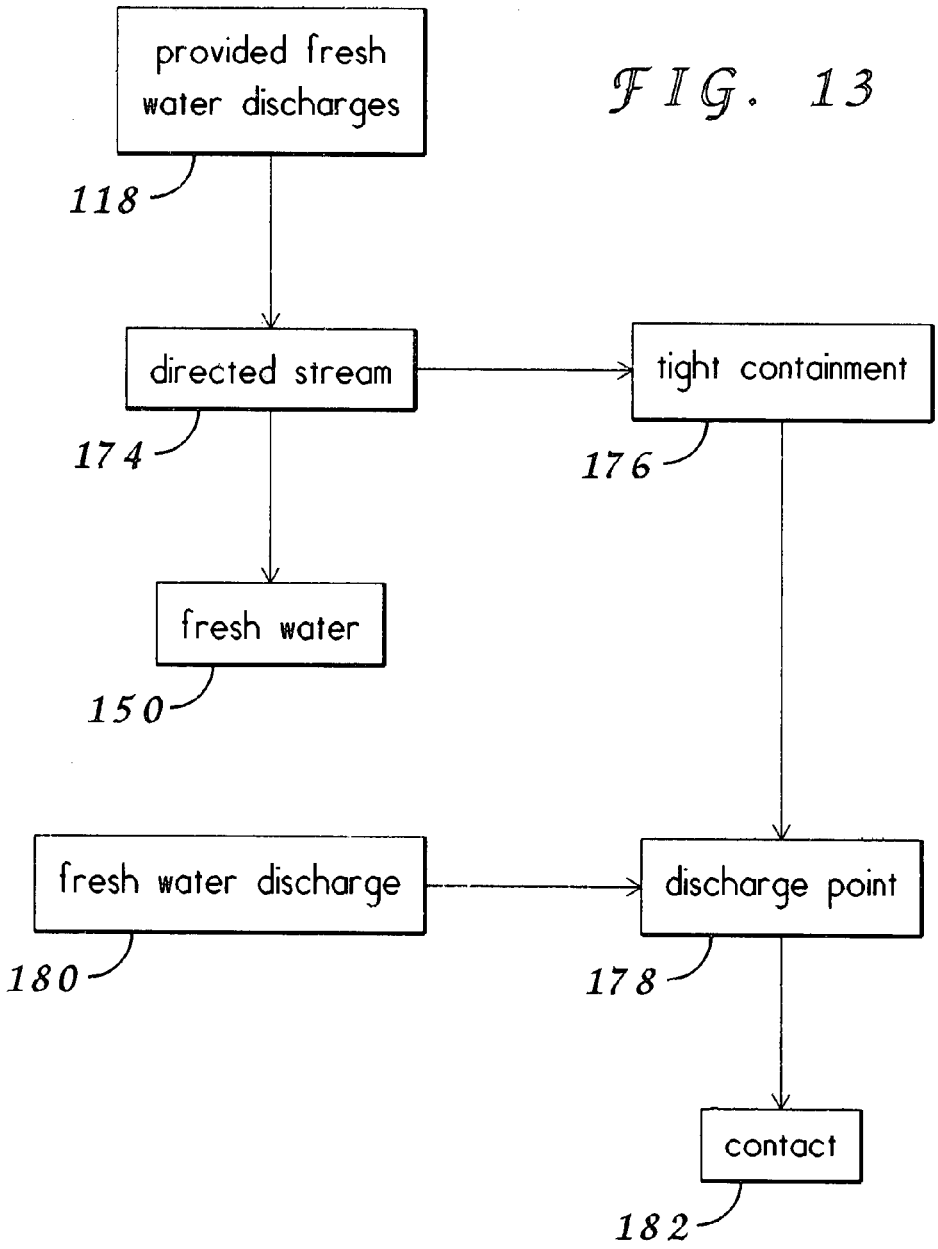

Referring now to FIG. 13, each 'provided fresh water discharge' 118 further comprises a 'directed stream' 174 of 'fresh water' 150 during operation where each 'directed stream' 174 of 'fresh water' 150 maintain a 'tight containment' 176 from a 'discharge point' 178 from 'fresh water discharge' 180 to a 'contact' 182.

Figure 10:
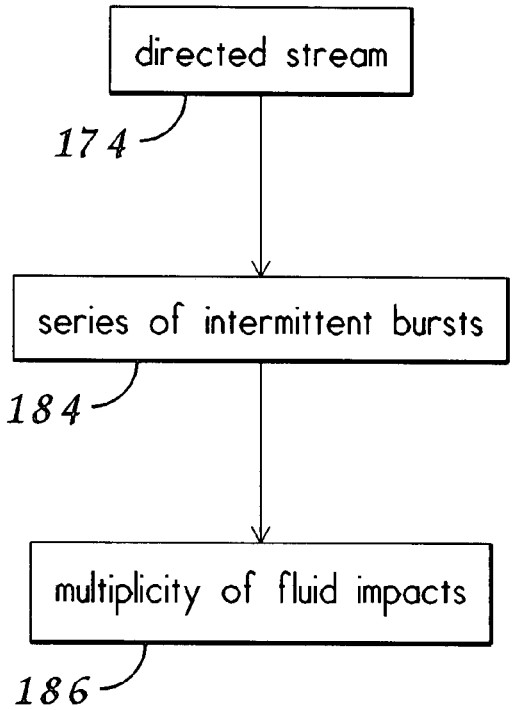

Referring now to FIG. 10, each 'directed stream' 174 of water further comprise a 'series of intermittent bursts' 184 where a 'multiplicity of fluid impacts' 186 occur during operation.

Figure 14:
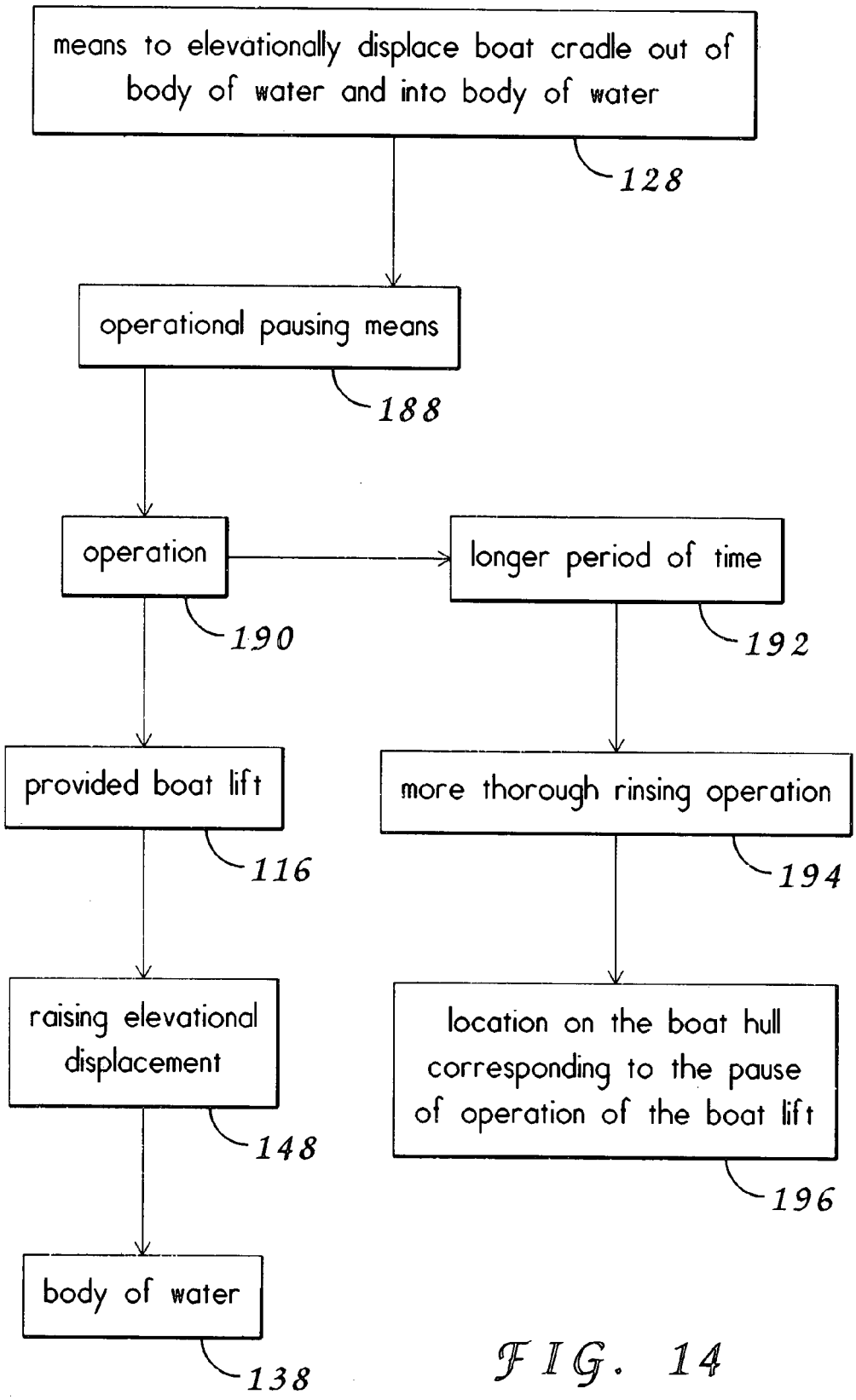

Referring now to FIG. 14, 'means to elevationally displace boat cradle out of body of water and into body of water' 128 further comprises 'operational pausing means' 188 to deliberately pause an 'operation' 190 of 'provided boat lift' 116 during 'raising elevational displacement' 148 out of 'body of water' 138 where a 'longer period of time' 192 is consumed to provide for a 'more thorough rinsing operation' 194 to occur at a 'location on the boat hull corresponding to the pause of operation of the boat lift' 196.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A boat hull rinsing device to operate in cooperation with a boat lift to provide for rinsing of a hull of a boat during a raising elevational displacement of the boat out of a body of water utilizing the boat lift, the boat lift having a fixed portion and a boat cradle, the boat cradle elevationally displaceable relative to the body of water by the boat lift, the boat hull rinsing device comprising:

a) a plurality of fresh water discharges positioned on opposing sides of the boat cradle of the boat lift, each of the fresh water discharges generally at a fixed elevation relative to the fixed portion of the boat lift, each of the fresh water discharges generally at a fixed horizontal position relative to the fixed portion of the boat lift and directed generally toward the boat cradle of the boat lift and wherein each of the fresh water discharges remain generally stationary and do not move significantly forward or back along the boat and do not move significantly toward or away from the boat during operation;

b) means to commence and terminate discharge from the plurality of fresh water discharges during the raising elevational displacement of the boat out of the body of water utilizing the boat lift wherein fresh water is discharged during at least a portion of the raising elevational displacement of the boat out of the body of water utilizing the boat lift.

2. The boat hull rinsing device defined in claim 1 wherein the fresh water discharges cooperate to provide for the rinsing of the boat hull generally from a deck of the boat downward during the raising elevational displacement of the boat out of the body of water utilizing the boat lift.

3. The boat hull rinsing device defined in claim 1 wherein each fresh water discharge further comprises a directed stream of fresh water during operation of the boat hull rinsing device wherein each of the directed streams of water maintain a tight containment from discharge point from the fresh water discharge to contact with the hull of the boat.

4. The boat hull rinsing device defined in claim 3 wherein each of the directed stream of water may further comprises a series of intermittent bursts where a multiplicity of fluid impacts occur on the hull of the boat during the raising elevational displacement of the boat out of the body of water utilizing the boat lift.

5. The boat hull rinsing device defined in claim 1 may further comprise oscillation means to provide for discharge from each fresh water discharge oscillating through an angle of discharge.

6. The boat hull rinsing device defined in claim 1 wherein each of the fresh water discharges disperse fresh water in a series of steps across an angle of discharge in a repetitive cycle during the raising elevational displacement of the boat out of the body of water utilizing the boat lift and wherein each angle of discharges of adjacent fresh water discharges on a respective side of the boat lift overlap significantly on the hull of the boat at some point during operation of the boat hull rinsing device.

7. The boat hull rinsing device defined in claim 1 wherein the means to commence and terminate fresh water discharge is synchronized to commence the fresh water discharge automatically a predefined occasion during operation of the boat lift to raise the boat.

8. The boat hull rinsing device defined in claim 1 wherein the means to commence and terminate fresh water discharge is synchronized to terminate the fresh water discharge automatically at a predefined occasion during operation of the boat lift to raise the boat.

9. The boat hull rinsing device defined in claim 1 further comprising opposing fan fresh water discharges, each of the opposing fan fresh water discharges positioned on opposing sides of the boat cradle of the boat lift and at a fixed elevational relative to the fixed portion of the boat lift and each directed generally toward the boat cradle of the boat lift, each fan fresh water discharge having a dispersal pattern which covers an angle of discharge and where the angle of discharge is generally horizontal and wherein the means to commence and terminate fresh water discharge also causes operation of the fan fresh water discharges during the raising elevational displacement of the boat out of the body of water utilizing the boat lift wherein fresh water is discharge from the fan fresh water discharge during at least a portion of the raising elevational displacement of the boat out of the body of water utilizing the boat lift.

10. The boat hull rinsing device defined in claim 9 wherein the opposing fan fresh water discharges are positioned to impact fresh water in a fan shaped discharge orientation on an aft section of the boat during the raising elevational displacement of the boat out of the body of water utilizing the boat lift.

11. The boat hull rinsing device defined in claim 10 wherein each of the opposing fan fresh water discharges are positioned for fixed stationary discharge of fresh water.

12. A boat hull rinsing device to operate in cooperation with a boat lift to provide for rinsing of a hull of a boat during a raising elevational displacement of the boat out of a body of water utilizing the boat lift, the boat lift having a fixed portion and a boat cradle, the boat cradle elevationally displaceable relative to the body of water by the boat lift, the boat hull rinsing device comprising:

a) a plurality of fresh water discharges positioned on opposing sides of the boat cradle of the boat lift, each of the fresh water discharges generally at a fixed elevation relative to the fixed portion of the boat lift and directed generally toward the boat cradle of the boat lift, wherein each of the fresh water discharges further comprise a sprinkler type head for spraying a stream of fresh water in a series of steps across an angle of discharge in a repetitive cycle during the raising elevational displacement of the boat out of the body of water utilizing the boat lift;

b) means to commence and terminate discharge from the plurality of fresh water discharges during the raising elevational displacement of the boat out of the body of water utilizing the boat lift wherein fresh water is discharged during at least a portion of the raising elevational displacement of the boat out of the body of water utilizing the boat lift.

13. A method of fresh water rinsing a portion of a hull of a boat during a removal of the boat from a body of water utilizing a boat lift, the method comprising the steps of:

a) providing a boat lift having:

i) a fixed portion;

ii) a boat retainer elevationally displaceable by the boat lift relative to the fixed portion, the boat retainer to engage the hull of the boat during a removal of the boat from the body of water;

iii) means to elevationally displace the boat out of the body of water and into the body of water;

b) providing a plurality of fresh water discharges positioned on opposing sides of the boat, each fresh water discharge generally restricted to a fixed elevational position relative to the fixed portion of the boat lift, and wherein each of the provided fresh water discharges further comprise a sprinkler type head for spraying a stream of fresh water in a series of steps across an angle of discharge in a repetitive cycle during the raising elevational displacement of the boat out of the body of water utilizing the boat lift, then;

c) elevationally displacing the boat to remove the boat from the body of water, while;

d) discharging fresh water from each of the fresh water discharges during at least a portion of the elevational displacement of the boat wherein fresh water makes contact with a portion of the boat hull during the elevational displacement of the boat to rinse the portion of the boat to remove water of the body of water deposited on the boat hull.

14. The method defined in claim 13 wherein the step of discharging fresh water occurs to rinse the boat hull generally from a deck of the boat downward.

15. The method defined in claim 13 wherein each of the provided fresh water discharges further comprise oscillation means to provide for oscillating discharge through an angle of discharge.

16. The method defined in claim 13 wherein each of the provided fresh water discharges disperse fresh water in a series of steps across an angle of discharge in a repetitive cycle during the raising elevational displacement of the boat out of the body of water utilizing the boat lift and wherein each angle of discharge of adjacent fresh water discharges on a respective side of the boat lift overlap significantly on the boat hull of the boat at some point during operation of the boat lift.

17. The method defined in claim 13 wherein each of the provided fresh water discharges further comprise a directed stream of fresh water during operation wherein each of the directed streams of water maintain a tight containment from discharge point from the fresh water discharge to contact.

18. The method defined in claim 17 wherein each of the directed stream of water further comprise a series of intermittent bursts where a multiplicity of fluid impacts occur during operation.

19. The method defined in claim 13 wherein the means to elevationally displace the boat out of the body of water and into the body of water further comprises operational pausing means to deliberately pause an operation of the boat lift during the elevational displacement of the boat out of the body of water where a longer period of time is consumed to provide for a more thorough rinsing operation to occur at a location on the boat hull corresponding to the pause of operation of the boat lift.

* * * * *